United States Patent [19]

Rae

[11] Patent Number: 4,974,748

[45] Date of Patent: Dec. 4, 1990

[54] TOOTHPASTE TUBE ACCESSORY

[76] Inventor: Judy J. Rae, 145 Helena Ave., Yonkers, N.Y. 10710

[21] Appl. No.: 491,869

[22] Filed: Mar. 12, 1990

[51] Int. Cl.[5] ..... B67B 7/00

[52] U.S. Cl. ..... 222/1; 222/106; 222/192; 222/575; 401/139; 401/261; 401/292

[58] Field of Search ..... 222/92, 93, 106, 107, 222/189, 192, 575; 401/14, 15, 25, 27, 48, 137, 139, 193, 195, 261, 292

[56] References Cited

U.S. PATENT DOCUMENTS

| | | | |
|---|---|---|---|
| 1,212,138 | 1/1917 | Glasow et al. | 222/93 |
| 2,552,715 | 5/1951 | Gray et al. | 222/92 X |
| 2,623,523 | 12/1952 | Bensn | 222/461 X |
| 2,982,987 | 5/1961 | Knapp | 401/139 |
| 4,590,974 | 5/1986 | Mathews | 222/461 X |
| 4,705,194 | 11/1987 | Judge | 222/93 X |

*Primary Examiner*—Kevin P. Shaver

[57] ABSTRACT

A disposable attachment to the dispensing end of a toothpaste tube which obviates contact between the tube exit opening and the toothbrush bristles to minimize the spread of infection among multiple users of the toothpaste, in which the disposable attachment has a leg with a V-shaped notch in a forward edge thereof through which notch the toothpaste is squeezed onto the bristles of the toothbrush while the leg prevents contact of the tube exit opening with the toothbrush bristles because of an interposed position therebetween.

1 Claim, 1 Drawing Sheet

TOOTHPASTE TUBE ACCESSORY

The present invention relates to improvements for a toothpaste tube, and more particularly to an attachment or accessory for use with the toothpaste tube which minimizes the spread of infection or the like to subsequent users thereof.

The referred to infection or diseases that could possibly be spread are hepatitis B, AIDS, herpes simplex, influenza, and diseases causing strep throat. These diseases can be contracted by direct contact with saliva or blood of an infected person. Moreover, since most people at some point suffer from a periodontal problem (gum disease) which causes bleeding, there is real cause for concern, for example, where family members may be prone to contract one disease or another from someone else's contaminated toothbrush contacting the toothpaste tube exiting opening or toothpaste contents at said exit opening.

EXAMPLES OF THE PRIOR ART

There are numerous prior patented examples of improved toothpaste tube caps, such as U.S. Pat. No. 1,442,440 issued on Jan. 16, 1923 to Messinger. These improvements, however, are not pertinent because the cap does not permit the passage of, or the dispensing of, toothpaste through the cap.

In the above regard, to achieve the objective of minimizing the spread of infection, the within invention contemplates a toothpaste tube cap that permits toothpaste to be dispensed therethrough, and also is so inexpensive that it is in the category of a disposable, so that it is, in fact, disposed of after each use so that contact of the cap by the bristles of the toothbrush does not cause contamination for a subsequent user of the toothpaste tube.

In the prior art that does disclose caps for toothpaste tubes through which the toothpaste contents are dispensed, it is appropriate to note U.S. Pat. No. 2,038,057 issued on Apr. 21, 1936 to Peters, U.S. Pat. No. 1,989,714 issued on Feb. 5, 1935 to Statham, and U.S. Pat. No. 3,726,446 issued on Apr. 16, 1973 to Hays. In none of the referenced and other known prior art patents is it described or suggested that the dispensing caps should be disposed of after each use.

The description of the invention which follows, together with the accompanying drawings should not be construed as limiting the invention to the example shown and described, because those skilled in the art to which this invention appertains will be able to devise other forms thereof within the ambit of the appended claims:

Figure 1:
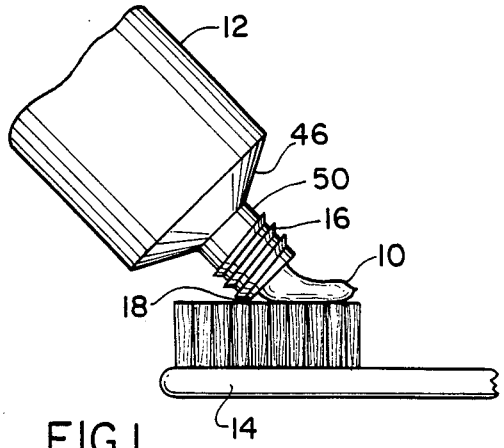
FIG.1 PRIOR ART
FIG. 1 illustrates a conventional procedure for dispensing toothpaste onto the bristles of a toothbrush.

It is common practice for members of a household to apply toothpaste 10 from a single toothpaste tube 12 to their individual toothbrushes 14 using a toothpaste dispensing procedure implicit from FIG. 1. This use of toothpaste tube and plural toothbrushes may occur several times a day and as currently practiced is far from antiseptic. More particularly, as depicted in FIG. 1 it is highly likely that each of brushes 14 by virtue of harboring undesirable pathogens, would in turn result in the transfer thereof to the threaded neck or collar 16 on tube 12, by contact of the circular edge bounding an end opening 18 with the bristles of the brush during the toothpaste 10 application. Some of toothpaste 10, as a consequence of the contact of the opening of collar 16 with a contaminated toothbrush may, therefore, even itself become contaminated. The prior art procedure of FIG. 1 thus contributes to possible spread of disease within a household.

Figure 4:
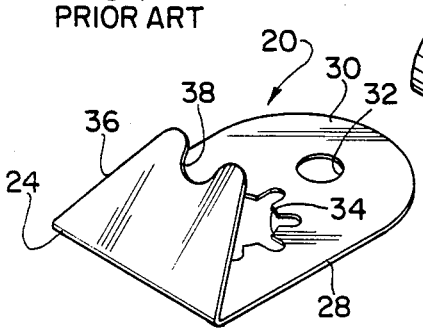
FIG. 4 is a perspective view of the member of FIG. 2.
Figure 3:
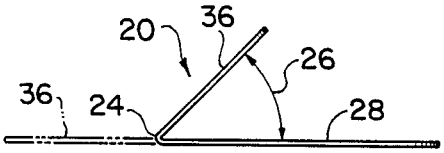
FIG. 3 is a side view illustrating further structural details of the member of FIG. 2.
Figure 2:
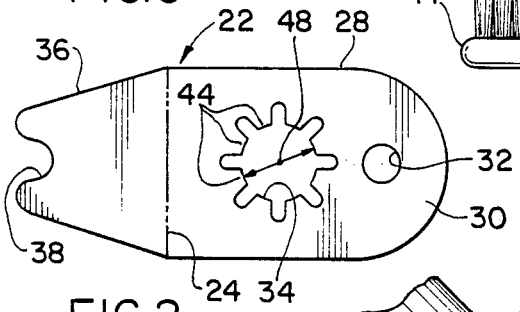
FIG. 2 is a plan view of an operative member used during the within inventive toothpaste dispensing procedure.

As best seen in FIGS. 2, 3 and 4, a disease-obviating procedure is proposed contemplating the use of an operative member 20 consisting of a supply of a single stamping 22 (FIG. 2) die cut from a thin plastic (0.010"–0.015") sheet. Each stamped blank 22 is then folded along line 24 to an approximate 45 degree-55 degree internal angle 26, as seen in FIG. 3, and used in the toothpaste dispensing procedure now to be described.

The main portion 28 of member 20 is made so as to have a handle section 30. Within section 30 an aperture 32 is added to aid in gripping the member 20. Adjacent handle 30, a serrated opening 34 is provided to fit about the threaded collar 16 of the toothpaste tube 12 thus allowing member 20 to act as a shield, as will now be explained.

The outer end of the tapered leg 36 of the blank 22 has a V-shaped notch 38, as best seen in FIG. 3, to which a radius has been applied to what would be the points of the "V".

Figure 5:
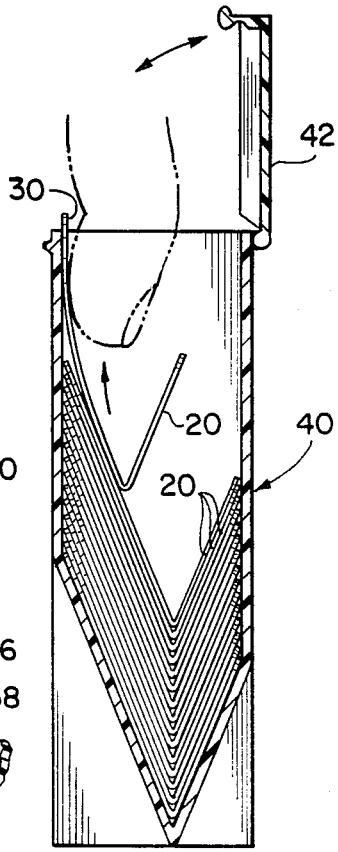
FIG. 5 is a vertical cross section of a container with a supply of the members of FIG. 2.

After removing the customary cap (not shown) from toothpaste tube 12, the user of member 20 is expected to open the container or dispenser 40 (FIG. 5), and to remove a single unit 20 therefrom. Plastic container 40 is rectangular in horizontal cross section and has a hinged snap cap 42. An array of shield members 20 are nested within container 40 and can readily be withdrawn by the index finger of the user. This arrangement protects the remaining shields 20 from being touched, and affords a compact storage holder for several dozen shield members 20.

Figure 6:
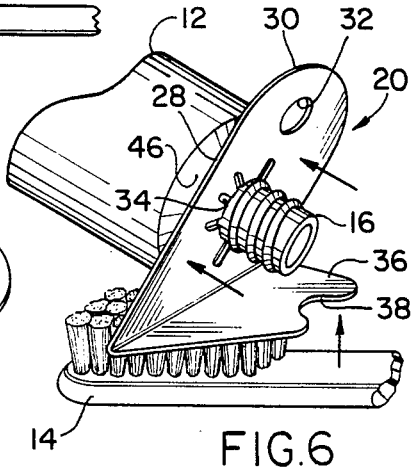
FIG. 6 is a perspective view illustrating the within inventive toothpaste dispensing procedure.

After closing cap 42 and with a shield 20 in hand, the user maneuvers the serrated opening 34 about the threaded collar 16 of tube 12. Then, with pressure on the face of main portion 28, and with tapered leg 36 facing away from tube 12, unit 20 is pushed over the threads on collar 16 against shoulder 46 (FIG. 6). The inside diameter 48 of serrated opening 34 is sized to provide a snug fit about the neck portion 50 (FIG. 1) of collar 16. Internal fingers 44 of opening will be understood to be flexible enough to allow passage over the threaded portion of collar 16. When shield 20 is positioned on tube 12, leg 36 is not yet in contact with threaded collar 16.

Figure 7:
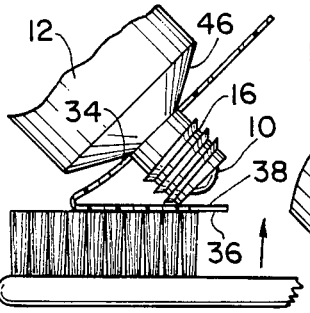
FIG. 7 is a sectional view projected from FIG. 6.
Figure 8:
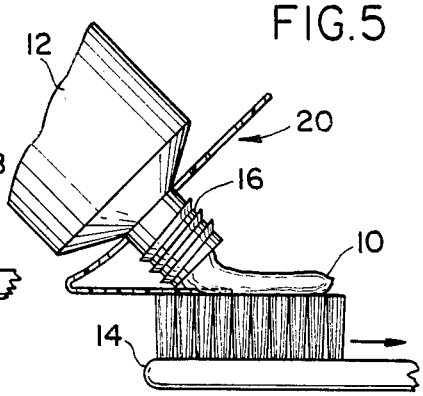
FIGS. 8, 9 and 10 are views similar to FIG. 7, but at subsequent stages of toothpaste application.
Figure 9:
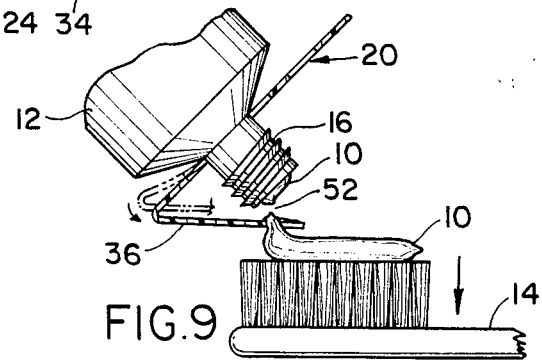
Figure 10:
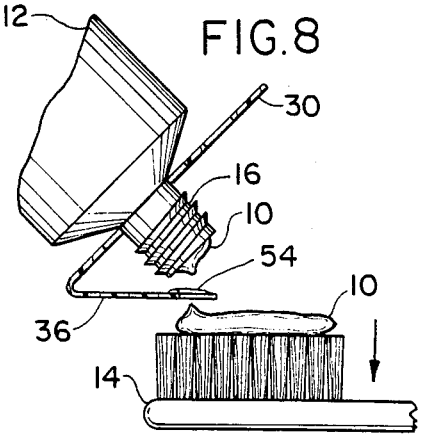

With shield 20 in place, as shown in FIGS. 6 and 7, toothbrush 14 is raised from below and brought to bear centrally against the tapered leg 36. At the same time, the user begins to squeeze a bead of paste 10 from the tube 12 just as leaf or leg 36 flexes against collar 16. Leaf 36 is now between point 18 on collar 16 and brush 14. As seen in FIG. 8, movement of brush 14 to the right draws the toothpaste bead 10 along with it and over the cutout 38. When adequate paste 10 has been applied to brush 14, the user stops squeezing tube 12 and then lowers brush 14, thereby removing it from the shield 20. Leaf 36 will then pull away (FIG. 9) and cause the separation of the bead 10 at point 52.

Brush 14 is now ready to use. A tiny portion of paste 10 may harmlessly remain at 54 on the leaf or leg 36. The user is now expected to remove and dispose of the shield 20 and replace a cap on tube 12.

From the foregoing description it should be readily appreciated that the operative member or shield 20 serves as a convenient, inexpensive, disposable interface between collar 16 and brush 14 during an application of toothpaste 10, thus preventing any transfer of pathogens to the remaining supply of toothpaste 10 or to the tube 12.

While the particular toothpaste dispensing apparatus and method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In a method of dispensing for personal use of toothpaste using a dispenser of the type consisting of a squeezable tube with a supply of toothpaste therein having a cylindrical neck extending therefrom bounding an exit passage terminating in a neck circular edge bounding an exit opening through which toothpaste is squeezed from said tube onto bristles of a toothbrush, the improvements to said method to obviate the subsequent spread of infection resulting from said toothpaste dispensing comprising the steps of mounting an operative member on said tube neck having a leg with a V-shaped notch, positioning said operative member leg in an interposed position between said neck exit opening edge and said toothbrush bristles with said V-shaped notch thereof in adjacent position to said tube exit opening, and during relative movement between said toothbrush bristles and said tube squeezing toothpaste from said tube exit opening through said V-shaped notch onto said toothbrush bristles, whereby there is no contact between said toothpaste tube exit opening with any possible contaminants on said toothbrush bristles.

* * * * *